US010281191B2

(12) United States Patent
Arslankiray et al.

(10) Patent No.: US 10,281,191 B2
(45) Date of Patent: May 7, 2019

(54) HOME APPLIANCE DOOR

(71) Applicant: BSH HAUSGERAETE GMBH, Munich (DE)

(72) Inventors: Ziya Arslankiray, Tekirdag (TR); Ercan Engin, Tekirdag (TR); Tanzer Yildizgoecer, Tekirdag (TR)

(73) Assignee: BSH Hausgeraete GmbH, Munich (DE)

( * ) Notice: Subject to any disclaimer, the term of this patent is extended or adjusted under 35 U.S.C. 154(b) by 225 days.

(21) Appl. No.: 15/360,208

(22) Filed: Nov. 23, 2016

(65) Prior Publication Data

US 2018/0142941 A1 May 24, 2018

(51) Int. Cl.

| | |
|---|---|
| ***F25D 23/02*** | (2006.01) |
| ***F24C 15/02*** | (2006.01) |
| ***F25D 11/00*** | (2006.01) |
| ***E05B 1/00*** | (2006.01) |
| *F25D 23/10* | (2006.01) |

(52) U.S. Cl.

CPC ..... *F25D 23/02* (2013.01); *E05B 1/0015* (2013.01); *F24C 15/02* (2013.01); *F25D 11/00* (2013.01); *F25D 23/028* (2013.01); *F25D 23/10* (2013.01)

(58) Field of Classification Search

CPC ..... F25D 23/02; F25D 23/028; F25D 11/00; F24C 15/02

See application file for complete search history.

(56) References Cited

U.S. PATENT DOCUMENTS

| | | | | |
|---|---|---|---|---|
| 7,984,955 | B2 * | 7/2011 | Jung | F25D 23/028 16/412 |
| 8,336,974 | B2 * | 12/2012 | Lee | F25D 23/028 312/204 |
| 8,382,219 | B2 * | 2/2013 | Hottmann | A47B 88/40 312/348.4 |
| 8,382,220 | B2 * | 2/2013 | Kim | B44C 5/04 312/223.5 |
| 2002/0068224 | A1 * | 6/2002 | Danda | G03H 1/0236 430/1 |
| 2003/0151339 | A1 * | 8/2003 | Reed | E05D 11/1078 312/405 |
| 2004/0222725 | A1 * | 11/2004 | Park | A47B 77/08 312/405 |
| 2008/0047295 | A1 * | 2/2008 | Kim | A47B 96/06 62/441 |
| 2008/0311349 | A1 * | 12/2008 | Johnson | C09J 7/0296 428/172 |
| 2009/0026903 | A1 * | 1/2009 | Laible | A47B 88/427 312/334.8 |
| 2009/0249824 | A1 * | 10/2009 | Koo | F25D 23/028 62/449 |
| 2010/0143724 | A1 * | 6/2010 | Johnson | B32B 27/08 428/424.4 |
| 2010/0327720 | A1 * | 12/2010 | Pae | F25D 23/028 312/405 |

(Continued)

*Primary Examiner* — Hanh V Tran

(74) *Attorney, Agent, or Firm* — Laurence A. Greenberg; Werner H. Stemer; Ralph E. Locher

(57) ABSTRACT

For the purpose of improving flexibility, a home appliance door, in particular a home chiller appliance door, is proposed: The home appliance door has at least one base body, the base body comprising at least one side wall with at least one setback for defining a door handle recess.

11 Claims, 5 Drawing Sheets

(56) References Cited

U.S. PATENT DOCUMENTS

| | | | | |
|---|---|---|---|---|
| 2011/0146335 | A1* | 6/2011 | Jung | F25C 5/005 62/441 |
| 2012/0042684 | A1* | 2/2012 | Lee | F25D 23/02 62/465 |
| 2012/0079845 | A1* | 4/2012 | Hong | F25D 25/025 62/407 |
| 2012/0121865 | A1* | 5/2012 | Jun | B32B 15/08 428/172 |
| 2013/0099650 | A1* | 4/2013 | Lee | F25D 23/028 312/404 |
| 2014/0150472 | A1* | 6/2014 | Boarman | F25B 21/02 62/56 |
| 2016/0209110 | A1* | 7/2016 | Cho | F25D 23/062 |

* cited by examiner

HOME APPLIANCE DOOR

BACKGROUND OF THE INVENTION

The invention relates to a home appliance door, for example a home chiller appliance door.

SUMMARY OF THE INVENTION

An object of the invention is to provide a home appliance door with improved characteristics regarding flexibility. This object is achieved, according to the invention, while further implementations and further developments of the invention may be gathered from the dependent claims.

A home appliance door, for example a home chiller appliance door, is proposed, comprising: at least one base body, the base body comprising at least one side wall with at least one or exactly one, setback for defining a door handle recess.

By means of the invention, a flexibility of the home appliance door can be improved. For example, a design of the home appliance door may be improved. Moreover, an improved stability of the home appliance door may be achieved. Thus, for example a fatigue strength and/or a durability of the home appliance door may be increased. In addition, an efficiency, for example a manufacturing efficiency, an installation space efficiency, a component efficiency and/or a cost efficiency, may be improved.

By a "home appliance door" is in particular to be understood at least a part and/or a portion, e.g. a sub-assembly group, of a home appliance which is in particular configured for closing and/or sealing off at least one storage space. The home appliance is in particular provided for storing and preferably tempering victuals such as beverages, meat, fish, vegetables, fruits, milk and/or dairy products in at least one operating state, advantageously for the purpose of enhancing a manageability of the stored victuals. For this purpose, the home appliance in particular comprises a housing defining the at least one storage space. For example, the home appliance is embodied as a home chiller appliance, which is in at least one operating state configured for cooling victuals. The home chiller appliance could in particular be embodied as a climate cabinet, an ice-box, a refrigerator, a freezer, a refrigerator-freezer combination and/or a wine cooler. However, the home appliance could also be embodied as a home appliance for warming and in particular for cooking victuals, e.g. an oven, a steamer and/or a microwave. In this context, "configured" is in particular to mean specifically programmed, designed and/or equipped. By an object being configured for a certain function is in particular to be understood that the object implements and/or fulfills said certain function in at least one application state and/or operating state.

Moreover, the base body may define a main part of the home appliance door and may be configured for covering the storage space at least largely or completely. For this purpose, the base body may comprise at least one rear wall which in particular faces the storage space, at least one front wall which, in particular, faces away from the storage space, and/or at least one side wall which in particular connects the rear wall and the front wall. The base body may comprise at least two or at least three and or four side walls connected to each other. The rear wall and/or the front wall may define a main extension plane of the base body, which is at least substantially parallel to an, in particular horizontally oriented, base and/or ground. The side wall may be arranged at least substantially perpendicularly to the main extension plane of the base body. In addition, the home appliance door may comprise at least one front cover element, e.g. a decorative panel, a decorative frame and/or a furniture door, covering the front wall of the base body. In this context, a "main extension plane" of an object is, in particular, to be understood as a plane extending parallel to a largest side of an imaginary rectangular cuboid which only just entirely encloses the object and preferably extends through a geometric center of the object. Moreover, "at least substantially parallel" is in particular to be understood as an orientation of a direction with respect to a reference direction, in particular in a plane, wherein the direction and the reference direction include an angle of 0°, the orientation in particular having a deviation of less than 15°, advantageously of less than 10° and particularly advantageously of less than 2°. Furthermore, "at least substantially perpendicular" is in particular to be understood as an orientation of a direction with respect to a reference direction, in particular in a plane, wherein the direction and the reference direction form an angle of 90° the orientation in particular having a deviation of less than 15°, advantageously of less than 10° and particularly advantageously of less than 2°. In addition, the term "at least largely" is to mean, in particular, at least 55%, advantageously at least 65%, preferably at least 75%, more preferably at least 85% and particularly advantageously at least 95%.

A "setback" is in particular to be understood as a step-like recession and/or a stepped structure, in particular comprising exactly one step, in particular if viewed in a direction at least substantially perpendicular to the front wall and preferably starting from the front wall, in particular a front edge connecting the front wall and the side wall. Therefore, the side wall may comprise a stepped structure merely extending in one direction, in particular such that the stepped structure continuously increases or continuously decreases. A "door handle recess" is in particular to be understood as a recess which is configured to receive a door handle which is preferably different from a pure coating and/or as a recess which directly forms at least a part and/or a portion of a door handle. The door handle recess and/or the door handle may be covered by and/or hidden by the front wall and/or the front cover element, at least when viewed in a direction which is at least substantially perpendicular to the main extension plane of the base body. The door handle recess and/or the door handle may be configured for applying an opening force, in particular for opening the home appliance door. The home appliance door may be free from a door handle protruding from the front wall in a direction away from the storage space. By the expression "for defining a door handle recess", it is in particular to be understood that the setback is configured for creating space for a door handle and/or for forming at least a part and/or a portion of a door handle.

In particular, for decreasing an opening force and/or increasing an ease of use, it is proposed that the door handle recess has a depth of at least 10 mm or at least 12.5 mm or at least 15 mm.

Furthermore, the base body may be implemented as a closed hollow body, which may be filled with insulation material, for example a foam insulation, and/or containing insulation material, for example a foam insulation. In this case, the base body can be implemented in a plurality of parts and/or integrally. "Implemented integrally" is in particular to mean, in this context, connected at least by substance-to-substance bond, e.g. by a welding process, an adhesive bonding, an injection-molding process and/or by another process that is deemed expedient by a person having ordinary skill in the art. For example, "implemented integrally" could in particular mean made of one piece. "Made of one piece" is, in particular, to mean, in this context, manufactured from one single piece, e.g. by production from one single cast and/or by manufacturing in a one-component or multi-component injection-molding process, and advantageously from a single blank. In this way, in particular a heat exchange can be controlled. Moreover, a manufacturing efficiency may be advantageously improved.

The base body may comprise at least one or exactly one rear edge protrusion delimiting the setback. The rear edge protrusion may be arranged in close vicinity of a rear edge connecting the rear wall and the side wall. The rear edge protrusion may protrude from the side wall in a direction which is parallel to the main extension plane of the base body. In addition, the rear edge protrusion may extend at least largely and or completely over the entire side wall. The base body may comprise exactly one protrusion, in particular the rear edge protrusion. In this context, a "close vicinity" is in particular to be understood as a spatial region which is defined by points which have a distance from a reference point and/or a reference component which is less than 3 cm or less than 2 cm or less than 1 cm or less than 0.5 cm. In this way, the door handle recess and/or the door handle can be implemented particularly easy.

A particularly high stability and/or easy sealing may be achieved if the rear edge protrusion contains insulation material, in particular the aforementioned insulation material, for example a foam insulation.

The home appliance door may further comprise at least one side element, which may be different from a mere coating and contacts the side wall. The side element is, in particular, implemented separately from the base body and may be connected to the base body in a form-fit and/or force-fit manner. The side element may be implemented integrally. In this way, in particular, a fatigue strength and/or a durability of the home appliance door may be improved.

Also the side element may extend at least largely or completely over the side wall. In this way, in particular, a manufacturing process and/or assembling process can be improved. Moreover, a design of the home appliance door may be improved.

In addition, the side element may be arranged at least partly in the door handle recess. A shape of the side element may be adapted and/or may correspond to the door handle recess. The side element may comprise a further setback corresponding to the setback of the side wall. Thus, in particular a usability and/or haptic of the home appliance door may be improved.

The side element may be implemented as a side cover element, for example for covering the side wall of the base body and in particular installation parts of the base body. In this way, in particular a design of the home appliance door can be improved. Moreover, the base body and in particular the door handle recess and/or the door handle can be protected from dirt and/or dust.

The side element can be implemented at least partly, at least largely and/or completely of plastic. Alternatively, the side element may be implemented at least partly, at least largely or completely of metal, in particular steel and/or aluminum. By using steel or aluminum, in particular, a fatigue strength and/or a durability of the home appliance door may be improved.

If the side element forms at least a portion of a door handle, in particular of the aforementioned door handle, in particular an installation space efficiency and/or a cost efficiency can be improved.

Furthermore, the home appliance door may further comprise at least one front cover element, in particular the aforementioned front cover element, which is implemented separately from the base body and connected to the base body in an assembled state, for example in a form-fit, a force-fit and/or a bonded manner. The front cover element may be dimensionally stable. In this way, in particular, a particularly flexible home appliance door can be obtained. Moreover, in particular an appearance of the home appliance door can be individually adapted.

In one embodiment of the invention, it the front cover element and the base body, in particular the side wall and/or the side element, may cooperate to form a door handle, in particular the aforementioned door handle. The term "cooperate" is to mean, in particular, directly delimiting and/or forming. In this way, in particular, an installation space efficiency and/or a component efficiency can be improved.

Herein the home appliance door is not to be limited to the application and implementation described above. In particular, for the purpose of fulfilling a functionality herein described, the home appliance door may comprise a number of respective elements, structural components and units that differs from the number mentioned herein. Furthermore, regarding the value ranges mentioned in this disclosure, values within the limits mentioned are to be understood to be also disclosed and to be used as applicable.

Further advantages may become apparent from the following description of the drawing. In the drawing exemplary embodiments of the invention are shown. The drawing, the description and the claims contain a plurality of features in combination. The person having ordinary skill in the art will purposefully also consider the features separately and will find further expedient combinations.

DETAILED DESCRIPTION OF THE INVENTION

Figure 1:
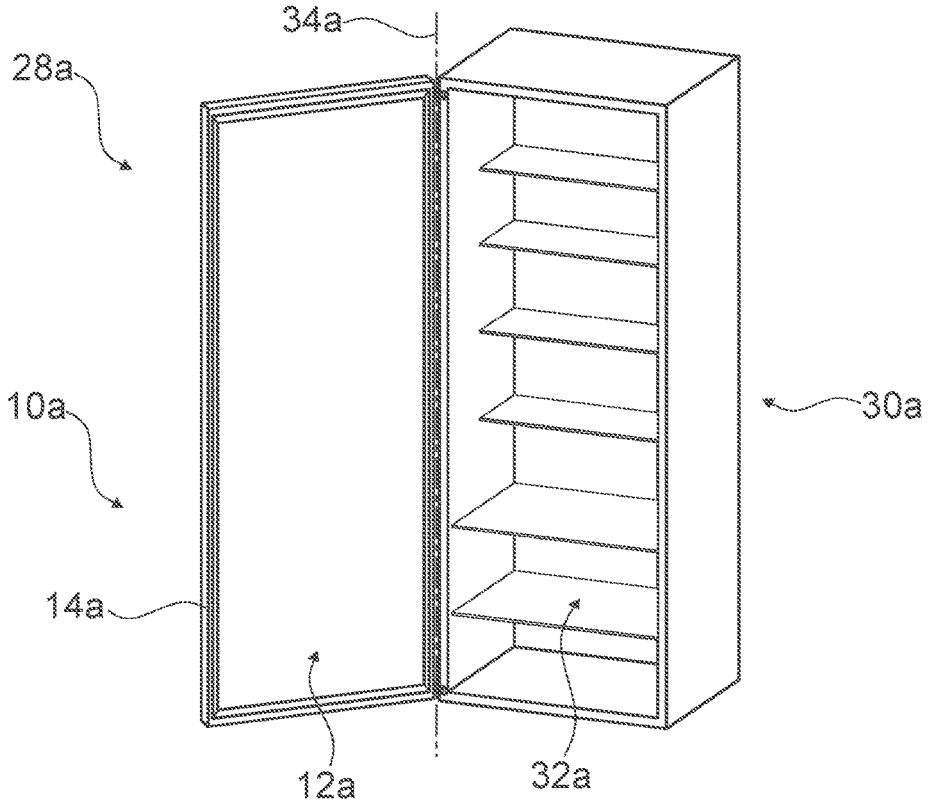
FIG. 1 a home appliance comprising a housing and a home appliance door, in a schematic front view, FIG. 2 the home appliance door in a perspective top view, FIG. 3 a portion of the home appliance door showing a side wall of a base body with a setback, FIG. 4 the portion of the home appliance door, in a cross-sectional view, FIG. 5 a further home appliance comprising a further housing and a further home appliance door, in a schematic front view, FIG. 6 the home appliance door shown in FIG. 5, in a first perspective top view, FIG. 7 the home appliance door shown in FIG. 5, in a second perspective top view, FIG. 8 the home appliance door shown in FIG. 5, in an exploded view, and FIG. 9 a portion of the home appliance door shown in FIG. 5, in a cross-sectional view.

FIG. 1 shows a perspective view of an exemplary home appliance 28*a*. In the present case, the home appliance 28*a* is implemented as a home chiller appliance, in particular a refrigerator. Alternatively, a home appliance could be embodied as any other home chiller appliance, like a freezer, a refrigerator-freezer combination and/or a wine cooler. In addition, a home appliance could also be embodied as a home appliance for warming and in particular for cooking victuals, e.g. an oven, a steamer and/or a microwave.

The home appliance 28*a* is configured for cooling victuals. For this purpose, the home appliance 28*a* comprises a housing 30*a*. The housing 30*a* defines a storage space 32*a*, in particular for storing and tempering the victuals.

The home appliance 28*a* further comprises a home appliance door 10*a*. The home appliance door 10*a* is movably connected to the housing 30*a*. In the present case, the home appliance door 10*a* is pivotally connected to the housing 30*a*. The home appliance door 10*a* is pivotable about a pivot axis 34*a* which is perpendicular to a base, a ground and/or a floor space of the home appliance 28*a*. In a closed state, the home appliance door 10*a* closes off and seals off the housing 30*a*, in particular the storage space 32*a*. Alternatively, a home appliance door could be pivotable about a pivot axis which is parallel to a base, a ground and/or a floor space of a home appliance. Moreover, a home appliance door can be connected to a housing in a linearly movable manner and/or in a push-pull manner.

Figure 2:
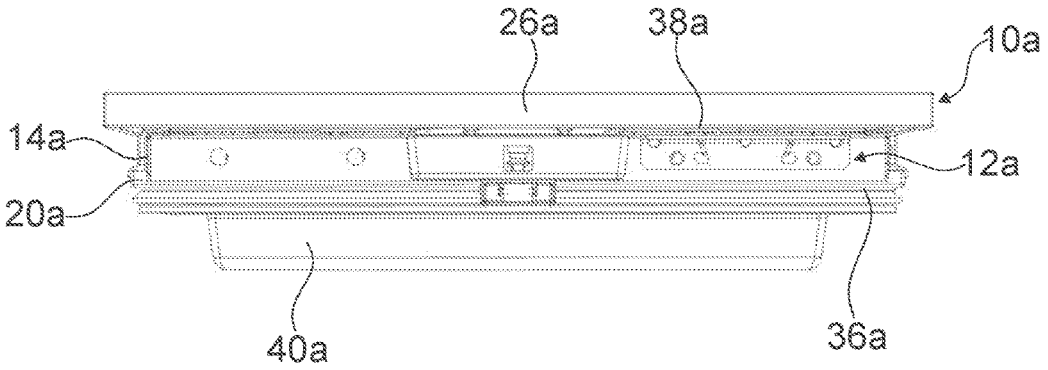
Figure 3:
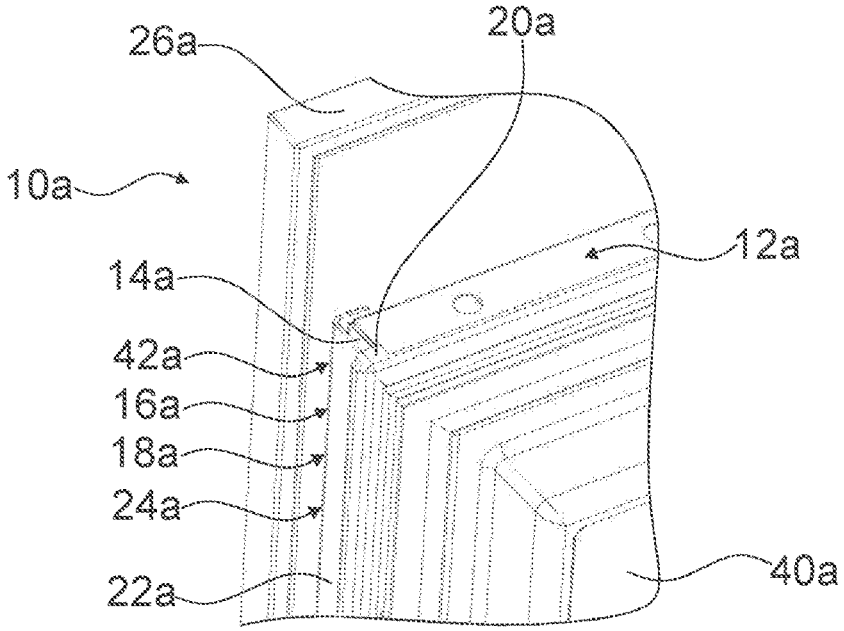
Figure 4:
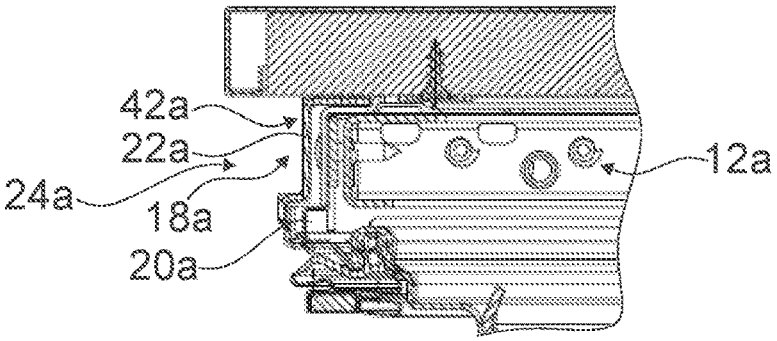

FIGS. 2 to 4 show the home appliance door 10*a* in different views. The home appliance door 10*a* comprises a base body 12*a*. The base body 12*a* defines a main part of the home appliance door 10*a*. The base body 12*a* is implemented as a closed hollow body. The base body 12*a* is implemented at least partly integrally. The base body 12*a* is filled with insulation material, in the present case in particular foam material. The base body 12*a* is configured for covering the storage space 32*a* completely.

The base body 12*a* comprises a rear wall 36*a*. The rear wall 36*a* faces the storage space 32*a*. The rear wall 36*a* is stepped. The rear wall 36*a* is at least sectionally convex and comprises at least one bulge 40*a* for receiving the insulation material. The base body 12*a* comprises a front wall 38*a*. The front wall 38*a* faces away from the storage space 32*a*. The front wall 38*a* is at least substantially and/or at least sectionally parallel to the rear wall 36*a*. The rear wall 36*a* and the front wall 38*a* define a main extension plane of the base body 12*a*. The main extension plane of the base body 12*a* is at least substantially parallel to the base, the ground and/or the floor space of the home appliance 28*a*.

In addition, the base body 12*a* comprises at least one side wall 14*a*. The side wall 14*a* connects the rear wall 36*a* and the front wall 38*a*. The side wall 14*a* is arranged at least substantially perpendicular to the main extension plane of the base body 12*a*. In the present case, the side wall 14*a* is a lateral side wall. The side wall 14*a* comprises a longitudinal extension which is at least substantially parallel to the pivot axis 34*a* and/or at least substantially perpendicular to the base, the ground and/or the floor space of the home appliance 28*a*. The side wall 14*a* is situated opposite the pivot axis 34*a*. Moreover, the side wall 14*a* is implemented integrally with the rear wall 36*a* and/or the front wall 38*a*. Alternatively, a rear wall, a front wall and/or a side wall can be implemented in a plurality of parts.

The side wall 14*a* comprises at least one setback 16*a*. In the present case, the side wall 14*a* comprises exactly one setback 16*a*. The setback 16*a* corresponds to a step-like recession. The setback 16*a* starts from the front wall 38*a* and extends towards the rear wall 36*a*. The setback 16*a* extends over at least 60% or at least 70% or at least 80% or at least 90% of the side wall 14*a*. The setback 16*a* defines, in the present case in particular creates space for, a door handle recess 18*a*. The door handle recess 18*a* has a depth of at least 15 mm. Alternatively, a side wall can comprise at least two, at least three and/or at least four setbacks.

Moreover, the base body 12*a* comprises at least one rear edge protrusion 20*a*. In the present case, the base body 12*a* comprises exactly one rear edge protrusion 20*a*. The rear edge protrusion 20*a* contains the insulation material. The rear edge protrusion 20*a* defines and/or forms at least a part and/or a portion of the side wall 14*a*. The rear edge protrusion 20*a* is arranged in close vicinity of a rear edge connecting the rear wall 36*a* and the side wall 14*a*. The rear edge protrusion 20*a* protrudes in a direction which is parallel to the main extension plane of the base body 12*a*. In the present case, the rear edge protrusion 20*a* protrudes in a direction which is perpendicular to the pivot axis 34*a*. The rear edge protrusion 20*a* delimits the setback 16*a*. Moreover, the rear edge protrusion 20*a* delimits the door handle recess 18*a*. Alternatively, a base body can comprise at least two, at least three and/or at least four protrusions.

In addition, the home appliance door 10*a* comprises at least one front cover element 26*a*. In the present case, the home appliance door 10*a* comprises exactly one front cover element 26*a*. The front cover element 26*a* is implemented separately from the base body 12*a*. The front cover element 26*a* is connected to the base body 12*a* in an assembled state. In the present case, the front cover element 26*a* is connected to the base body 12*a* in a form-fit and/or force-fit manner. The front cover element 26*a* is arranged above the front wall 38*a* in particular in such a manner that the front wall 38*a* is completely covered by the front cover element 26*a*. In the present case, the front cover element 26*a* is implemented as a furniture door. Moreover, the front cover element 26*a* delimits the setback 16*a*, in particular a side of the setback 16*a* which is situated opposite the rear edge protrusion 20*a*. Moreover, the front cover element 26*a* delimits the door handle recess 18*a*. In the present case, the door handle recess 18*a* is covered by and/or hidden by the front cover element 26*a* at least when viewed in a direction which is at least substantially perpendicular to the main extension plane of the base body 12*a*. Alternatively, a front cover element can be connected to a base body in an adhesively-bonded and/or cohesively-bonded manner. Moreover, a front cover element can be implemented as a decorative panel and/or a decorative frame. In addition, a front cover element can cover merely a portion of a front wall.

Furthermore, the home appliance door 10*a* comprises at least one side element 22*a*. In the present case, the home appliance door 10*a* comprises exactly one side element 22*a*. The side element 22*a* is implemented separately from the base body 12*a*. The side element 22*a* is moreover implemented separately from the front cover element 26*a*. The side element 22*a* is implemented integrally. The side element 22*a* is at least substantially plate-shaped. The side element 22*a* is implemented of metal, in the present case in particular aluminum. In an assembled state, the side element 22*a* is arranged in close vicinity of the side wall 14*a*. The side element 22*a* thereby contacts the side wall 14*a*. The side element 22*a* extends over the entire side wall 14*a*. The side element 22*a* is implemented as a side cover element for covering the side wall 14*a* of the base body 12*a* and in particular installation parts of the base body 12*a*.

Moreover, the side element 22*a* is arranged in the door handle recess 18*a*. A shape of the side element 22*a* is adapted to and/or corresponds to the door handle recess 18*a*. In the present case, the side element 22*a* comprises a further setback 42*a* corresponding to the setback 16*a* of the side wall 14*a*. The side element 22*a* delimits the setback 16*a*, in particular a side of the setback 16*a* which is at least substantially perpendicular to the front cover element 26*a* and/or the rear edge protrusion 20*a*. Besides, the side element 22*a* delimits the door handle recess 18*a*.

The side element 22*a* is connected to the base body 12*a*. In the present case, the side element 22*a* is connected to the base body 12*a* in a form-fit and/or force-fit manner. Moreover, the side element 22*a* is connected to the front cover element 26*a*. In the present case, the side element 22*a* is connected to the front cover element 26*a* in a form-fit and/or force-fit manner. As an alternative, it is conceivable to refrain from using a side element. Moreover, a side element can be connected to a base body and/or a front cover element in a bonded manner.

In the present case, the front cover element 26*a* and the base body 12*a*, in particular the rear edge protrusion 20*a* and the side element 22*a*, cooperate to form a door handle 24*a*. The door handle 24*a* corresponds to a further door handle recess which corresponds to the door handle recess 18*a*. The door handle 24*a* is stationary and/or immovable with respect to the base body 12*a*. The door handle 24*a* is configured for applying an opening force, in particular for uncovering the storage space 32*a*. As an alternative, it is conceivable to apply an additional coating to a door handle recess and/or a door handle, in particular to improve a durability and/or a haptic of the door handle recess and/or the door handle.

FIGS. 5 to 9 show a further exemplary embodiment of the invention. The following description is substantially limited to the differences between the exemplary embodiments, wherein regarding structural elements, features and functions that remain the same the description of the other exemplary embodiment, in particular the exemplary embodiment of FIGS. 1 to 4, may be referred to. For distinguishing the exemplary embodiments, the letter a of the reference numerals in the exemplary embodiment of FIGS. 1 to 4 has been substituted by the letter b in the reference numerals of the exemplary embodiment of FIGS. 5 to 9. Regarding structural elements having the same denomination, in particular regarding structural elements having the same reference numerals, principally the drawing and/or the description of the other exemplary embodiment, in particular of the exemplary embodiment of FIGS. 1 to 4, may be referred to.

Figure 5:
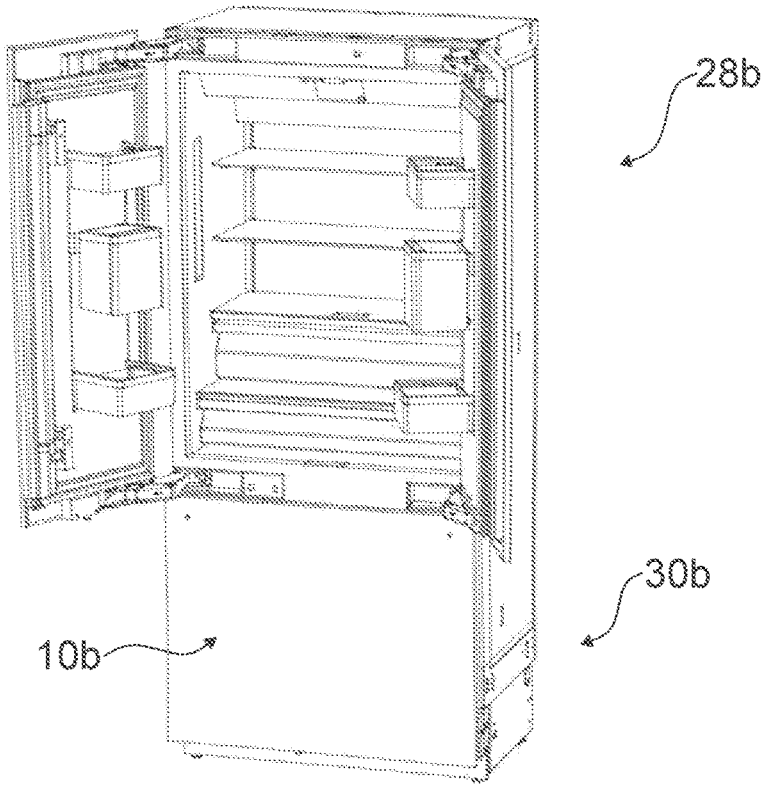
Figure 6:
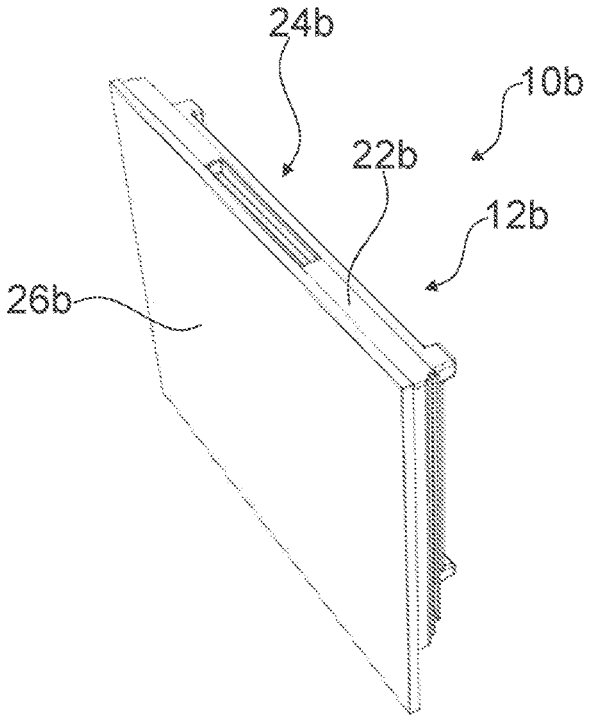
Figure 7:
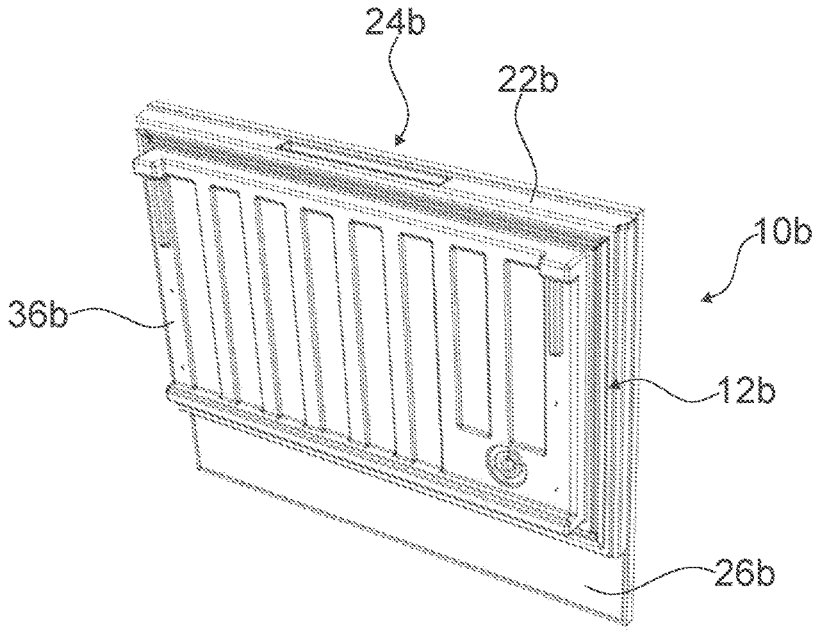

FIG. 5 shows a further home appliance 28*b* comprising a housing 30*b* defining at least one storage space and at least one home appliance door 10*b* which is configured for closing the storage space. The further home appliance 28*b* is implemented as a refrigerator-freezer combination. Moreover, the home appliance door 10*b* is connected to the housing 30*b* in a linearly movable manner and/or in a push-pull manner.

FIGS. 6 to 9 show the home appliance door 10*b* in different views. The home appliance door 10*b* comprises a base body 12*b* with a rear wall 36*b*, a front wall 38*b* and at least one side wall 14*b*. In addition, the home appliance door 10*b* comprises a side element 22*b* and a front cover element 26*b* each connected to the base body 12*b* in an assembled state.

Figure 8:
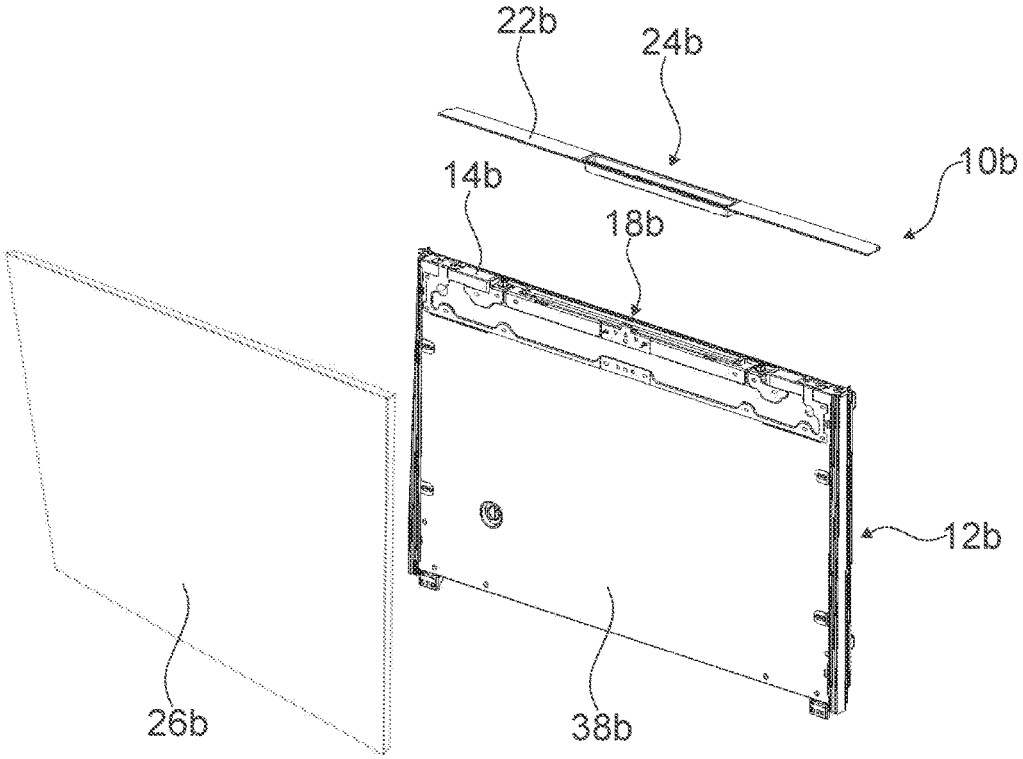
Figure 9:
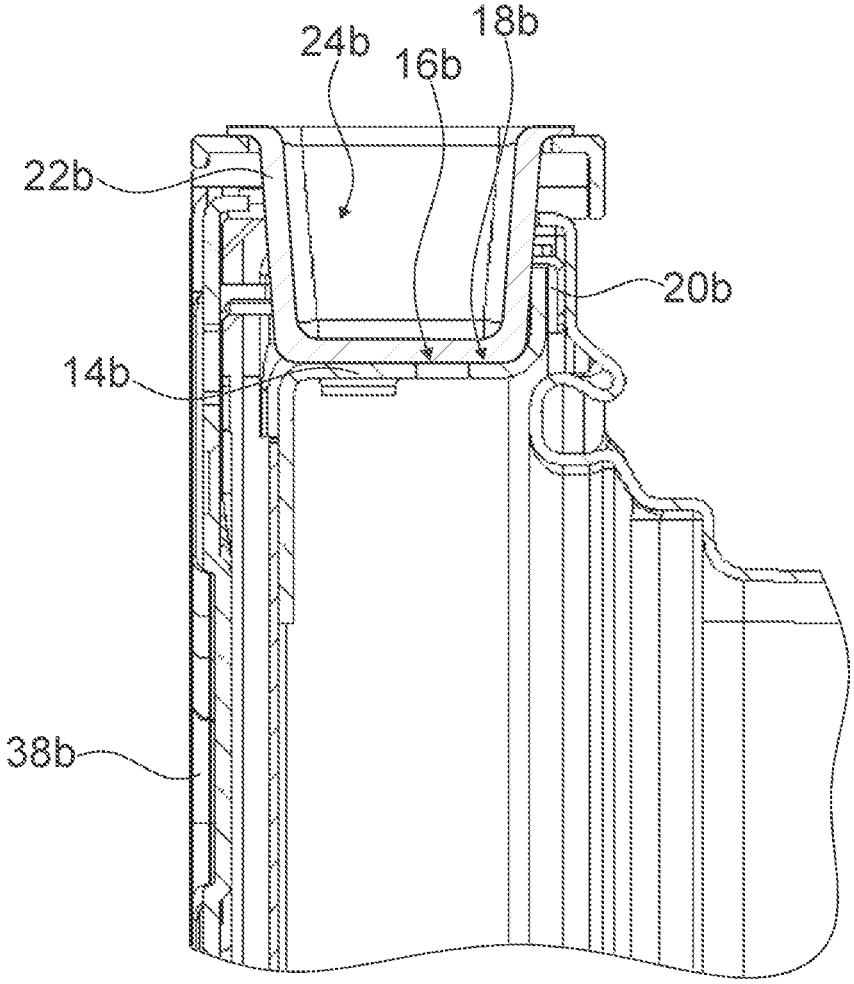

In the present case, the side wall 14*b* is an upper side wall and comprises exactly one setback 16*b* for defining a door handle recess 18*b* (see FIGS. 8 and 9). The side wall 14*b* has a longitudinal extension which is at least substantially parallel to a base, a ground and/or a floor space of the home appliance 28*b*. Moreover, the base body 12*b* comprises at least one rear edge protrusion 20*b* delimiting the setback 16*a*.

Furthermore, in the present case the side element 22*b* is implemented as a door handle recess element. Hence, the side element 22*b* forms a door handle 24*b*. The door handle 24*b* corresponds to a further door handle recess which corresponds to the door handle recess 18*b*. The door handle 24*b* is configured for applying an opening force, in particular for uncovering the storage space.

The following is a summary list of reference numerals and the corresponding structure used in the above description of the invention:

10 home appliance door
12 base body
14 side wall
16 setback
18 door handle recess
20 rear edge protrusion
22 side element
24 door handle
26 front cover element
28 home appliance
30 housing
32 storage space
34 pivot axis
36 rear wall
38 front wall
40 bulge
42 setback

The invention claimed is:

1. A home appliance door, comprising:

at least one base body, the base body comprising at least one side wall with at least one setback for defining a door handle recess;

at least one rear edge protrusion from said base body delimiting said setback, said rear edge protrusion containing insulation material;

at least one front cover element which is implemented separately from said base body and connected to said base body in an assembled state, said at least one front cover element delimiting the at least one setback on a side opposite that of the at least one rear protrusion; and said at least one front cover element and said base body cooperating to form a door handle.

2. The home appliance door according to claim 1, the door handle recess having a depth of at least 10 mm.

3. The home appliance door according to claim 1, the base body being implemented as a closed hollow body.

4. The home appliance door according to claim 1, further comprising at least one side element contacting the side wall.

5. The home appliance door according to claim 4, the side element extending at least largely over the side wall.

6. The home appliance door according to claim 4, the side element being arranged at least partly in the door handle recess.

7. The home appliance door according to claim 4, the side element being implemented as a side cover element.

8. The home appliance door according to claim 4, the side element being implemented at least partly of metal.

9. The home appliance door according to claim 4, the side element forming at least a portion of a door handle.

10. A home appliance, comprising a housing defining at least one storage space and at least one home appliance door according to claim 1, which is configured for closing the storage space.

11. A home chiller appliance, comprising a housing defining at least one storage space and at least one home appliance door according to claim 1, which is configured for closing the storage space.

* * * * *